US009766570B2

(12) United States Patent
Momomura et al.

(10) Patent No.: US 9,766,570 B2
(45) Date of Patent: Sep. 19, 2017

(54) BLOWER DUCT, BLOWER DEVICE, AND IMAGE FORMING APPARATUS

(71) Applicant: FUJI XEROX CO., LTD., Tokyo (JP)

(72) Inventors: Yasunori Momomura, Kanagawa (JP); Yuki Nagamori, Kanagawa (JP); Masafumi Kudo, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/218,194

(22) Filed: Jul. 25, 2016

(65) Prior Publication Data

US 2017/0242362 A1 Aug. 24, 2017

(30) Foreign Application Priority Data

Feb. 18, 2016 (JP) ..... 2016-029031

(51) Int. Cl.
*G03G 21/20* (2006.01)
*G03G 15/02* (2006.01)

(52) U.S. Cl.
CPC ..... *G03G 15/0258* (2013.01); *G03G 21/206* (2013.01)

(58) Field of Classification Search
CPC ..... G03G 15/0258; G03G 21/106
USPC ..... 399/92
See application file for complete search history.

(56) References Cited

U.S. PATENT DOCUMENTS 3,936,184 A * 2/1976 Tanaka ..... G03G 15/0258 399/93
5,655,187 A * 8/1997 Watanabe ..... G03G 15/0258 399/171
9,557,709 B1 * 1/2017 Momomura ..... G03G 21/206
2013/0064567 A1 * 3/2013 Akama ..... G03G 21/206 399/90
2013/0165036 A1 * 6/2013 Kudo ..... G03G 15/0291 399/170
2015/0261182 A1 * 9/2015 Katsumata ..... G03G 15/02 399/92

FOREIGN PATENT DOCUMENTS

JP 10-020723 A 1/1998
JP 2013-134412 A 7/2013

* cited by examiner

*Primary Examiner* — Susan Lee
(74) *Attorney, Agent, or Firm* — Sughrue Mion, PLLC

(57) ABSTRACT

A blower duct includes a path section and multiple suppressing sections. The path section connects an inlet and an outlet and allows air to flow therethrough. The suppressing sections are provided at different locations in the air flowing direction and suppress the flow of the air. The path section at least has an entrance path section and a first bent path section. One of the suppressing sections is a first suppressing section including a blocking portion and openings. The blocking portion is disposed in the first bent path section and blocks the flow of the air. The openings are disposed at different positions in one direction and include a first opening disposed closest to the inlet at a first height position where a height from a reference base surface of the first bent path section is larger than the remaining opening or openings.

7 Claims, 20 Drawing Sheets

BLOWER DUCT, BLOWER DEVICE, AND IMAGE FORMING APPARATUS

CROSS-REFERENCE TO RELATED APPLICATIONS

This application is based on and claims priority under 35 USC 119 from Japanese Patent Application No. 2016-029031 filed Feb. 18, 2016.

BACKGROUND

Technical Field

The present invention relates to blower ducts, blower devices, and image forming apparatuses.

SUMMARY

According to an aspect of the invention, there is provided a blower duct including a path section and multiple suppressing sections. The path section has a path that connects an inlet and an outlet and allows air to flow through the path. The inlet takes in the air, and the outlet ejects the air taken in from the inlet and has an opening shape that is long in one direction. The multiple suppressing sections are provided at different locations in a direction in which the air flows through the path of the path section and suppress the flow of the air. The path section at least has an entrance path section and a first bent path section. The entrance path section has a path whose one end is provided with the inlet. The first bent path section is bent from an intermediate position of the entrance path section and has a path with a cross-sectional shape that is long in one direction. One of the suppressing sections is a first suppressing section including a blocking portion and multiple openings. The blocking portion is disposed in a part of the path of the first bent path section and extends in the one direction of the cross-sectional shape so as to block the flow of the air. The multiple openings each have an opening shape that is long in the one direction of the cross-sectional shape and are disposed at different positions in the one direction of the cross-sectional shape. The openings include a first opening that is disposed closest to the inlet in the one direction of the cross-sectional shape. The first opening is disposed at a first height position, which is where a height from a reference base surface of the path of the first bent path section is larger than the remaining one or more openings.

BRIEF DESCRIPTION OF THE DRAWINGS

Exemplary embodiments of the present invention will be described in detail based on the following figures, wherein.

DETAILED DESCRIPTION

Exemplary embodiments of the present invention will be described below with reference to the appended drawings.

First Exemplary Embodiment

Figure 1:
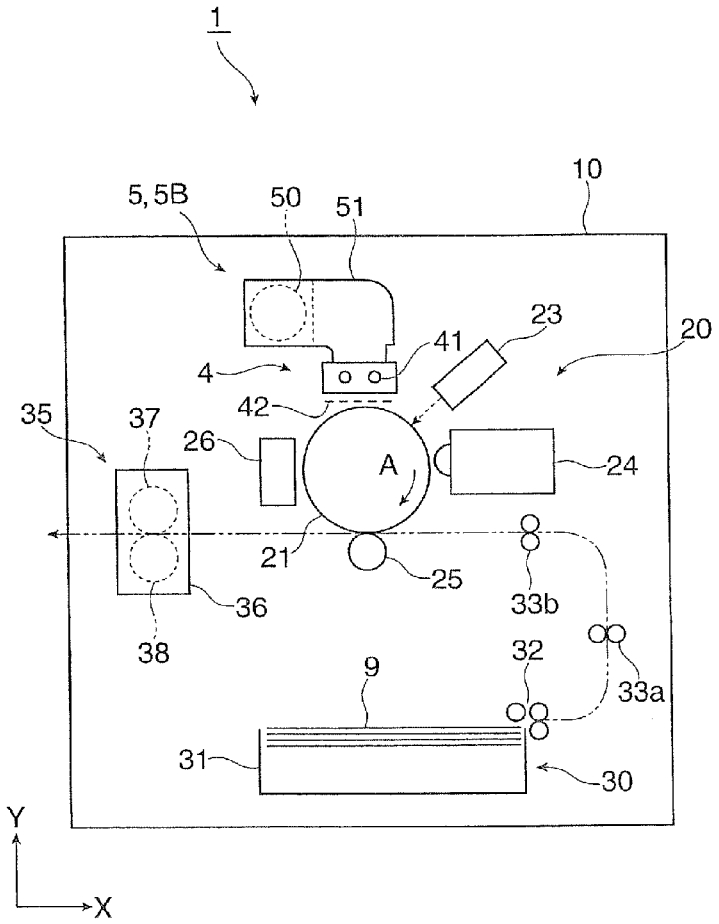
FIG. 1 schematically illustrates an image forming apparatus equipped with a blower device according to a first exemplary embodiment.
Figure 2:
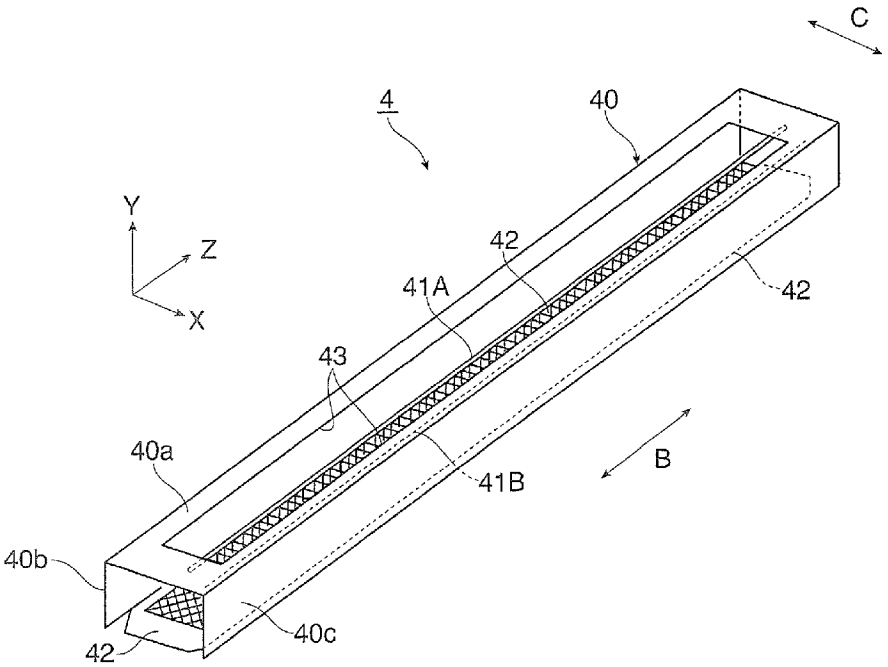
FIG. 2 is a perspective view schematically illustrating a charging device constituted of a corona discharger provided in the image forming apparatus in FIG. 1.
Figure 3:
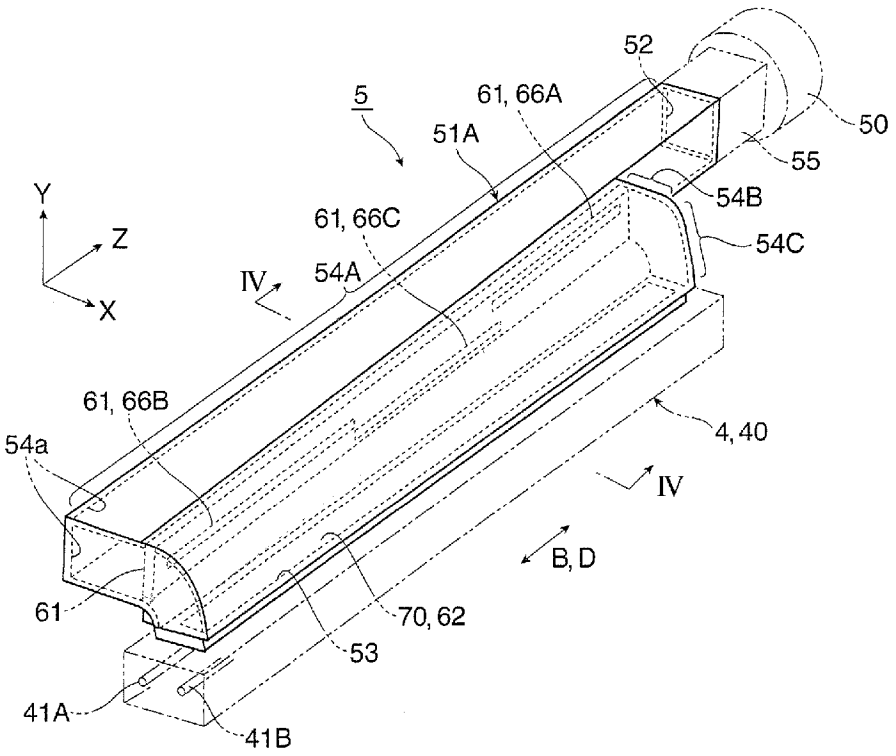
FIG. 3 is a perspective view schematically illustrating the blower device applied to the charging device in FIG. 2.
Figure 4:
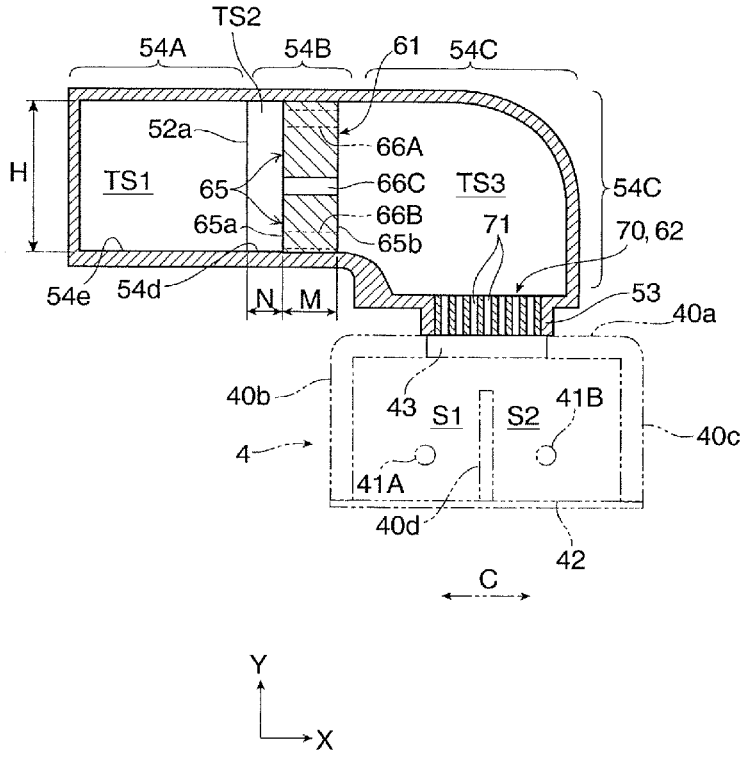
FIG. 4 is a cross-sectional view of the blower device (blower duct) in FIG. 3, taken along line IV-IV.

FIGS. 1 to 4 illustrate a blower duct according to a first exemplary embodiment, a blower device equipped with the blower duct, and an image forming apparatus equipped with the blower duct. Specifically, FIG. 1 schematically illustrates the image forming apparatus, FIG. 2 illustrates a charging device as an example of a corona discharger to which air is blown by the blower duct or the blower device, FIG. 3 schematically illustrates the blower duct or the blower device, and FIG. 4 is a cross-sectional view of, for example, the blower duct.

Configuration of Image Forming Apparatus

As shown in FIG. 1, an image forming apparatus 1 has a housing 10 constituted of, for example, a support frame and an outer cover. For example, the housing 10 has disposed therein an image forming unit 20 that forms a toner image formed of a toner as a developer and transfers the toner image onto recording paper 9 as an example of a recording medium, a paper feeding device 30 that accommodates and transports the recording paper 9 to be fed to the image forming unit 20, and a fixing device 35 that fixes the toner image formed by the image forming unit 20 onto the recording paper 9.

For example, the image forming unit 20 is of a known electrophotographic type. The image forming unit 20 according to the first exemplary embodiment includes a photoconductor drum 21 that is rotationally driven in a direction indicated by an arrow A; a charging device 4 that electrostatically charges, to a predetermined potential, a peripheral surface serving as an image formation region of the photoconductor drum 21; an exposure device 23 that radiates light (indicated by a dotted line with an arrow) based on image information (signal) input from the outside onto the electrostatically-charged peripheral surface of the photoconductor drum 21 so as to form an electrostatic latent image thereon; a developing device 24 that develops the electrostatic latent image into a toner image by using the toner; a transfer device 25 that transfers the toner image from the photoconductor drum 21 to the recording paper 9; and a cleaning device 26 that cleans the peripheral surface of the photoconductor drum 21 after the transfer process by removing waste, such as residual toner, therefrom.

A corona discharger is used as the charging device 4. As shown in, for example, FIG. 2, the charging device 4 constituted of the corona discharger is a so-called scorotron-type corona discharger.

Specifically, the charging device 4 includes a shield case 40 as an example of an enclosure member, two end supporters (not shown), two corona discharge wires 41A and 41B, and a porous grid electrode (electric-field adjustment plate) 42. The shield case 40 has a rectangular top plate 40*a* and side plates 40*b* and 40*c* hanging downward from the long edges, which extend in a longitudinal direction B, of the top plate 40*a*. The two end supporters are respectively attached to the opposite ends (i.e., short edges) of the shield case 40 in the longitudinal direction B. The two corona discharge wires 41A and 41B are disposed within a long internal space formed between the two end supporters and extending in the longitudinal direction B of the shield case 40. The two corona discharge wires 41A and 41B are attached in a manner such that they extend substantially parallel to each other. The grid electrode 42 is attached to a discharge opening in the lower surface of the shield case 40 so as to substantially cover the discharge opening and to be located between the corona discharge wires 41A and 41B and the peripheral surface of the photoconductor drum 21. Reference character 40*d* in, for example, FIG. 4 denotes a partition that partitions, in the longitudinal direction B of the shield case 40, the space in which the two corona discharge wires 41A and 41B are disposed. The discharge opening has a rectangular opening shape.

In the charging device 4, the two corona discharge wires 41A and 41B are disposed so as to face the peripheral surface of the photoconductor drum 21 with a predetermined distance (e.g., a discharge gap) therebetween and also to face the image formation region of the photoconductor drum 21 along a rotation shaft thereof. Furthermore, in the charging device 4, when image forming operation is to be performed, a charge voltage is supplied from a power source (not shown) between each of the corona discharge wires 41A and 41B and the photoconductor drum 21.

Moreover, as the charging device 4 is used, the corona discharge wires 41A and 41B and the grid electrode 42 may become contaminated due to paper particles from the recording paper 9, discharge products produced from corona discharge, and substances (waste), such as external additives in the toner. This may result in charge defects, such as uneven charge, due to insufficient or nonuniform corona discharge. Thus, for the prevention or reduction of the adhesion of waste onto the corona discharge wires 41A and 41B and the grid electrode 42, a blower device 5 for blowing air toward the corona discharge wires 41A and 41B and the grid electrode 42 is provided for the charging device 4. The top plate 40*a* of the shield case 40 of the charging device 4 has an air inlet opening 43 for taking in the air blown from the blower device 5. The air inlet opening 43 has a rectangular opening shape extending in the longitudinal direction B of the shield case 40. Furthermore, as shown in, for example, FIG. 9, the shield case 40 has gaps S3 and S4 respectively at the lower edge of the side plate 40*b* located at the upstream side in a rotational direction A of the photoconductor drum 21 and at the lower edge of the side plate 40*c* located at the downstream side. The gaps S3 and S4 are spaced apart from the peripheral surface of the photoconductor drum 21 by the same distance (discharge gap).

A detailed description of the blower device 5 will be provided later.

The paper feeding device 30 includes a paper accommodation body 31 that accommodates a stack of multiple sheets of recording paper 9 of, for example, a predetermined size and type to be used for image formation, and a delivering device 32 that delivers the sheets of recording paper 9 accommodated in the paper accommodation body 31 one-by-one toward a transport path. When it is time to feed the recording paper 9, the sheets of recording paper 9 are delivered one-by-one. In accordance with the intended use, multiple paper accommodation bodies 31 are provided. A two-dot chain line with an arrow in FIG. 1 denotes a transport path along which the recording paper 9 is transported and moved inside the housing 10. The transport path for the recording paper 9 is constituted of, for example, multiple pairs of paper transport rollers 33*a* and 33*b* and a transport guide member (not shown).

The fixing device 35 includes a heating rotation body 37 and a pressing rotation body 38 inside a housing 36 having an entrance port and an exit port through which the recording paper 9 passes. The heating rotation body 37 is of, for example, a roller type or a belt type whose surface temperature is heated to and maintained at a predetermined temperature by a heater. The pressing rotation body 38 is of, for example, a roller type or a belt type that is rotationally driven by coming into contact with the heating rotation body 37, with a predetermined pressure, substantially along a shaft thereof. In the fixing device 35, a contact section formed as a result of the heating rotation body 37 and the pressing rotation body 38 coming into contact with each other serves as a fixing processor where a predetermined fixing process (heating and pressing) is performed. The fixing process is performed by causing the recording paper 9 that has undergone a toner-image transport process to enter and pass through the contact section.

Image forming operation is performed by the image forming apparatus 1 in the following manner. Basic image forming operation performed when forming an image onto one face of the recording paper 9 will be described here as a representative example.

In the image forming apparatus 1, for example, when a controller (not shown) receives an image-forming-operation start command, the peripheral surface of the photoconductor drum 21 that starts to rotate in the image forming unit 20 is electrostatically charged to a predetermined polarity and potential by the charging device 4. In the charging device 4, a charge voltage is applied to each of the two corona discharge wires 41A and 41B so that corona discharge is generated in a state where an electric field is generated between each corona discharge wire 41A, 41B and the peripheral surface of the photoconductor drum 21, whereby the peripheral surface of the photoconductor drum 21 is electrostatically charged to a predetermined potential. In this case, the charge potential of the photoconductor drum 21 is adjusted by the grid electrode 42.

Subsequently, the exposure device 23 radiates light based on image information onto the electrostatically-charged peripheral surface of the photoconductor drum 21 so as to form an electrostatic latent image having a predetermined potential. Then, as the electrostatic latent image formed on the photoconductor drum 21 passes through the developing device 24, the electrostatic latent image is developed into a visible toner image by using a toner electrostatically charged to a predetermined polarity and supplied from a developing roller.

Subsequently, when the toner image formed on the photoconductor drum 21 is transported to a transfer position facing the transfer device 25 due to the rotation of the photoconductor drum 21, a transfer function of the transfer device 25 causes the toner image to be transferred onto the recording paper 9, which is fed from the paper feeding device 30 via the transport path in accordance with this timing. After this transfer process, the peripheral surface of the photoconductor drum 21 is cleaned by the cleaning device 26.

Then, the recording paper 9 having the toner image transferred thereon at the image forming unit 20 is separated from the photoconductor drum 21 and is subsequently transported to the fixing device 35. As the recording paper 9 passes through the contact section between the heating rotation body 37 and the pressing rotation body 38 of the fixing device 35, the recording paper 9 is pressed and heated so that the toner image fuses and becomes fixed onto the recording paper 9. Upon completion of this fixing process, the recording paper 9 is output from the fixing device 35 and is transported and accommodated into an output-paper accommodation section (not shown) provided, for example, outside the housing 10.

Accordingly, a monochromatic image formed of one color of toner is formed on one face of a single sheet of recording paper 9, and the basic image forming operation ends. If there is a command for forming images onto multiple sheets of recording paper 9, the above-described series of processes is similarly repeated for the number of sheets.

Configuration of Blower Device

Next, the blower device 5 will be described.

As shown in, for example, FIGS. 1 and 3, the blower device 5 includes a blower 50 having a rotating fan that blows air and a blower duct 51A that takes in the air blown from the blower 50 and guides and ejects the air to the charging device 4 as an example of a target structure to which the air is blown.

For example, a radial-flow blower fan is used as the blower 50. The blower 50 is driven and controlled so as to blow a predetermined amount of air.

As shown in, for example, FIGS. 3 to 7, the blower duct 51A has a path section (body section) 54 and two suppressing sections (i.e., a first suppressing section 61 and a second suppressing section 62). In the path section 54, a path TS that connects an inlet 52, which takes in the air blown from the blower 50, and an outlet 53, which ejects the air taken in through the inlet 52, for allowing the air to flow therethrough is bent twice at intermediate positions of the path section 54. The two suppressing sections suppress the flow of air and are provided at different locations in the direction in which the air flows through the path TS of the path section 54. The outlet 53 is disposed facing a longitudinal-direction-B portion (i.e., the air inlet opening 43 in the top plate 40*a* of the shield case 40) that is long in one direction of the charging device 4 to which the air taken in through the inlet 52 is blown.

The inlet 52 of the blower duct 51A has a rectangular opening shape in its entirety, which is slightly longer in the vertical direction, or has a square opening shape. A connection duct 55 for connecting the inlet 52 and the blower 50 so as to deliver the air produced by the blower 50 to the inlet 52 is attached to the inlet 52 of the blower duct 51A (FIG. 3).

The outlet 53 of the blower duct 51A has, for example, a rectangular opening shape that is long in one direction. Furthermore, the outlet 53 has a different opening shape (but including a similar opening shape) from that of the inlet 52. The outlet 53 in the first exemplary embodiment is formed in a rectangular opening shape such that the entire opening thereof substantially completely faces the air inlet opening 43 serving as a portion, which is long in one direction, of the shield case 40 of the charging device 4 to which air is blown. Furthermore, as shown in, for example, FIGS. 4 and 6, the outlet 53 is formed so as to have a slightly narrower opening area than the entire terminal end of a section located at the outlet 53 side of the path section 54 (i.e., a path TS of a second bent path section 54C).

Figure 5:
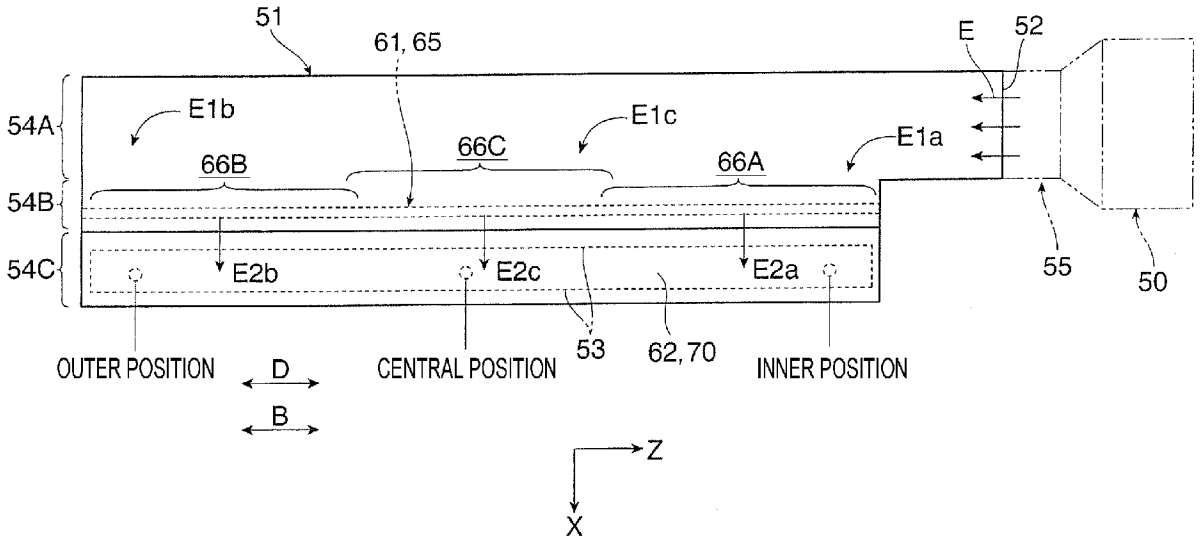
FIG. 5 schematically illustrates the blower device in FIG. 3, as viewed from above.

As shown in, for example, FIGS. 3 to 5, the path section 54 of the blower duct 51A is constituted of an entrance path section 54A, a first bent path section 54B, and a second bent path section 54C.

With regard to the entrance path section 54A, a first open end thereof serves as the inlet 52, and a second end thereof is closed. The entire entrance path section 54A is a path section with an angular tubular shape having a path TS1 extending linearly and substantially parallel to the longitudinal direction B of the outlet 53 (i.e., the same as the longitudinal direction B of the charging device 4).

The first bent path section 54B is a bent path section with an angular tubular shape having a path TS2 that is bent at a substantially right angle in the substantially horizontal direction (i.e., a direction substantially parallel to a direction indicated by a coordinate axis X), which is a lateral direction, from an area (intermediate area) located toward the second end of the entrance path section 54A. Moreover, as compared with the entrance path section 54A, the first bent path section 54B has, for example, a rectangular cross-sectional shape that is long in one direction and whose width W (i.e., the dimension in the longitudinal direction B) is increased while the height H of the path TS2 is maintained equal to the height H of the path TS1 of the entrance path section 54A. With regard to the first bent path section 54B in the first exemplary embodiment, a longitudinal direction D, which is the aforementioned one direction of the rectangular cross-sectional shape, in the path TS1 after the bent area is set to be substantially parallel to the longitudinal direction B of the outlet 53.

The second bent path section 54C has a path TS3 that is bent in a downward direction (i.e., a direction substantially parallel to a direction indicated by a coordinate axis Y), which is a predetermined direction, from a downstream end (terminal end) of the first bent path section 54B in the direction in which the air flows through the path TS2. Moreover, as compared with the first bent path section 54B, the second bent path section 54C has a rectangular shape that is wider in the lateral direction and is bent downward while the width (i.e., the dimension in the longitudinal direction B) of the path TS3 is maintained equal to the width W of the path TS2 of the first bent path section 54B. Furthermore, the second bent path section 54C is formed to have dimensions such that the bent terminal end thereof is connectable close to an area of the charging device 4 to which air is to be blown (i.e., the air inlet opening 43 of the shield case 40 in the first exemplary embodiment). The terminal end of the path TS3 in the second bent path section 54C is provided with the outlet 53 having the configuration described above.

As shown in, for example, FIGS. 3 to 5, and 7, the first suppressing section 61 in the blower duct 51A includes a blocking portion 65 and multiple openings 66 (66A to 66C). The blocking portion 65 is located in a part of the path TS2 of the first bent path section 54B and extends in the longitudinal direction D of the cross-sectional shape of the path TS2 so as to block the flow of air. The openings 66 each have a rectangular opening shape that is long in the longitudinal direction D of the cross-sectional shape of the path TS2 and are arranged at different positions in the longitudinal direction D of the cross-sectional shape.

The blocking portion 65 in the first suppressing section 61 is provided as a plate-shaped member in the bent area after the path TS2 of the first bent path section 54B and is disposed so as to traverse the path TS2 in the longitudinal direction D of the cross-sectional shape of the path TS2. Furthermore, the blocking portion 65 in the first exemplary embodiment is disposed such that an inner wall surface 65*a*, which is located at the upstream side in the air flowing direction, is displaced by a predetermined distance N from an end 52*a*, which is located closer toward the outlet 53 relative to the inlet 52, toward the downstream side in the air flowing direction in the first bent path section 54B (FIG. 4). Moreover, the upstream inner wall surface 65*a* and a downstream inner wall surface 65*b* of the blocking portion 65 are both flat surfaces. The thickness (M) of the blocking portion 65 in the air flowing direction is set to a dimension corresponding to a through-width of each opening 66, which will be described below.

Figure 7:
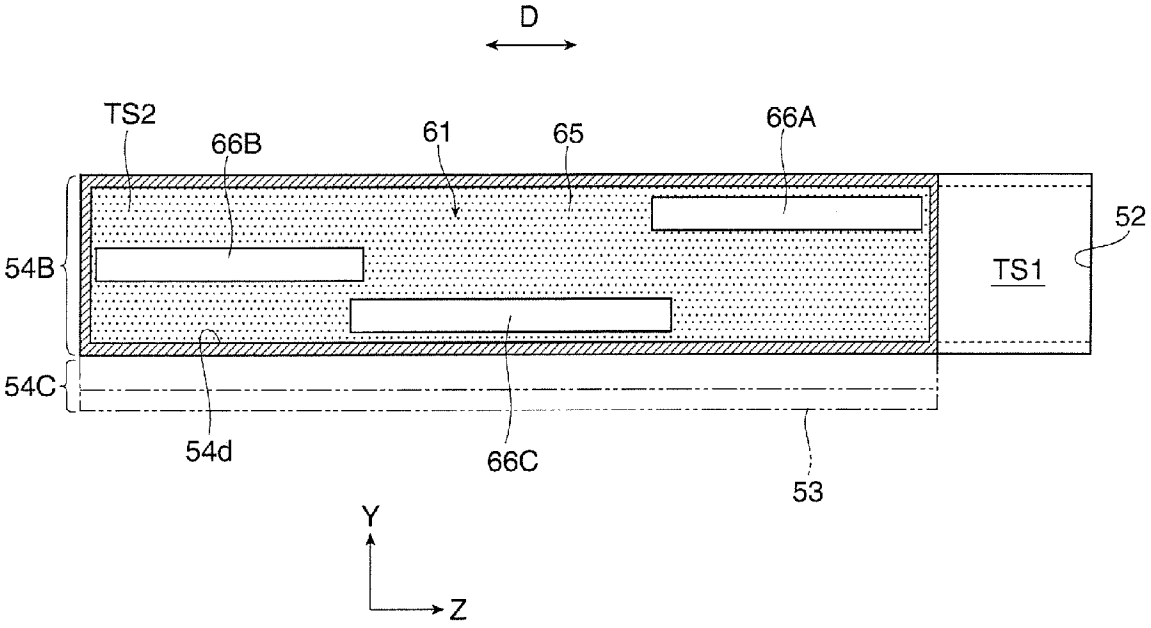
FIG. 7 is an enlarged view of a first suppressing section in the blower device (blower duct) in FIG. 3.
Figure 8:
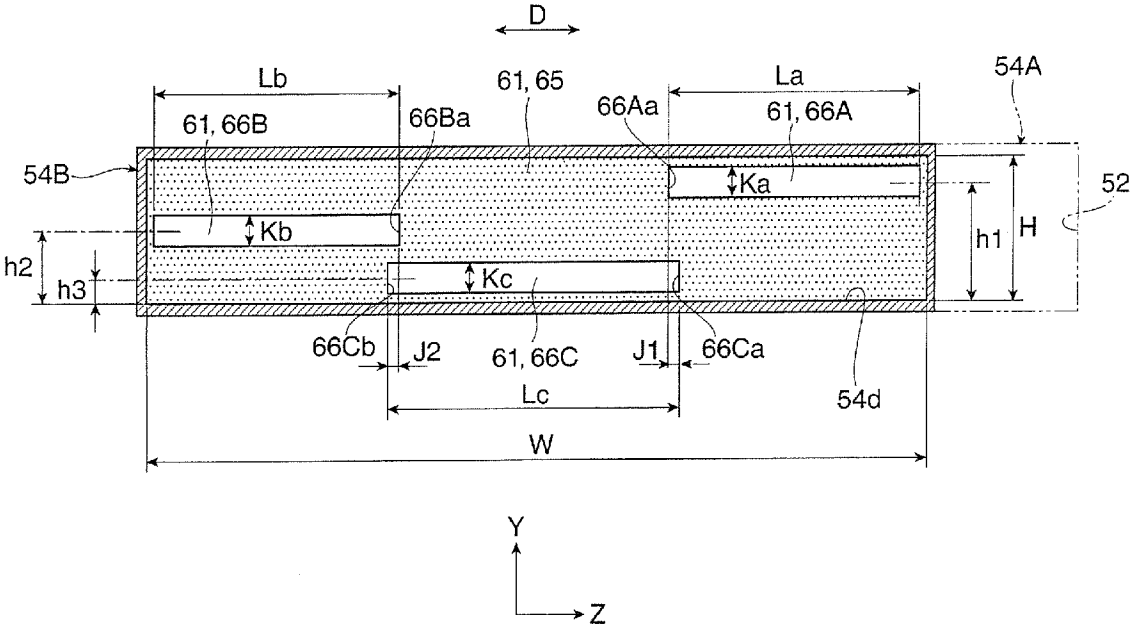
FIG. 8 is an enlarged view illustrating a detailed configuration of the first suppressing section in FIG. 7.

For example, as shown in FIGS. 4, 7, and 8, the multiple openings 66 in the first suppressing section 61 include a total of three openings, namely, a first opening 66A, a second opening 66B, and a third opening 66C.

As described above, the three openings 66A to 66C all have a rectangular opening shape and are provided in predetermined areas of the blocking portion 65 in actuality. With regard to the rectangular opening shape of each of the openings 66A to 66C, the openings 66A to 66C have predetermined lengths La, Lb, and Lc (i.e., the lengths of the long sides) in the longitudinal direction D of the cross-sectional shape of the path TS2 and predetermined heights Ka, Kb, and Kc (i.e., the lengths of the short sides). In this case, the lengths La, Lb, and Lc are set to identical dimensions but may alternatively set to partially or entirely different dimensions. Likewise, the heights Ka, Kb, and Kc are set to identical dimensions but may alternatively set to partially or entirely different dimensions. Furthermore, with regard to each of the openings 66A to 66C, the path length M, which is the length in the air passing direction as shown in FIG. 4, is set to a predetermined dimension. This path length M also corresponds to the thickness of the plate-shaped member constituting the blocking portion 65, as described above.

As shown in, for example, FIGS. 7 and 8, the first opening 66A is an opening disposed at the closest position to the inlet 52 in the longitudinal direction D of the cross-sectional shape of the path TS2 in the first bent path section 54B and is disposed at a first height position h1, which is where the height H from a reference base surface 54*d* of the path TS2 of the first bent path section 54B is relatively the largest. The second opening 66B is an opening disposed at the farthest position from the inlet 52 in the longitudinal direction D of the cross-sectional shape of the path TS2 and is disposed at a second height position h2 (<h1), which is where the height H from the base surface 54*d* is the second largest. The third opening 66C is the remaining opening disposed at least between the first opening 66A and the second opening 66B and is disposed at a third height position h3 (<h2), which is lower than the second height position h2.

The aforementioned reference base surface 54*d* is a surface selected for the sake of convenience as a reference location for specifying the positions of the multiple openings 66 in the height direction. Of the two long sides of the rectangular cross-sectional shape of the path TS2 in the first bent path section 54B, a surface including the long side located closer to the outlet 53 is selected as a reference base surface (54*d*) in the first exemplary embodiment. The reference base surface 54*d* in the first exemplary embodiment is formed as a flat surface that extends continuously from a base surface 54*e* of the path TS1 in the entrance path section 54A. Furthermore, the height positions h1 to h3 are set with reference to central positions of the heights Ka, Kb, and Kc of the openings 66A to 66C, respectively.

Furthermore, as shown in, for example, FIGS. 7 and 8, the three openings 66A to 66C have positional relationships such that the ends of adjoining openings 66 partially overlap each other in the longitudinal direction D of the cross-sectional shape of the path TS2.

In detail, the first opening 66A and the third opening 66C, which adjoin each other, have a positional relationship such that a first end 66Aa of the first opening 66A and a first end 66Ca of the third opening 66C overlap each other by a predetermined overlapping amount J1. Moreover, the second opening 66B and the third opening 66C, which adjoin each other, have a positional relationship such that a first end 66Ba of the second opening 66B and a second end 66Cb of the third opening 66C overlap each other by a predetermined overlapping amount J2. In this case, the two overlapping amounts J1 and J2 are set equal to each other but may alternatively be set to different dimensions.

Furthermore, as shown in, for example, FIGS. 7 and 8, the three openings 66A to 66C are disposed such that the ends thereof adjacent to four inner wall surfaces constituting the path TS2 of the first bent path section 54B are slightly disposed away from the adjacent inner wall surfaces. Alternatively, the three openings 66A to 66C may be disposed such that the ends thereof adjacent to the four inner wall surfaces are partially or entirely in contact with the adjacent inner wall surfaces.

For example, the first suppressing section 61 may be a member configured by providing (cutting out) through-holes serving as the three openings 66A to 66C in a plate-shaped member (with a thickness M) having the same shape as the cross-sectional shape of the path TS2 of the first bent path section 54B. In this case, in the plate-shaped member, a remaining portion excluding the three openings 66A to 66C serves as the blocking portion 65. The blocking portion 65 including the openings 66 in the first suppressing section 61 may be obtained by integral molding using the same material as the blower duct 51A or may be attached to the blower duct 51A after being formed using a material different therefrom.

The position (i.e., the aforementioned distance N) of the blocking portion 65 in the first suppressing section 61, the lengths La, Lb, and Lc and the heights Ka, Kb, and Kc of the opening shapes of the openings 66A to 66C, and the path length M thereof (which also corresponds to the thickness of the blocking portion 65) are selected and set in view of making the flow speed of air flowing into the first bent path section 54B from the entrance path section 54A uniform as much as possible. Furthermore, these values are also set in view of, for example, the dimensions (capacities) of the paths TS in the blower duct 51A and the flow rate per unit time of air to be blown to the blower duct 51A or the charging device 4.

Figure 6:
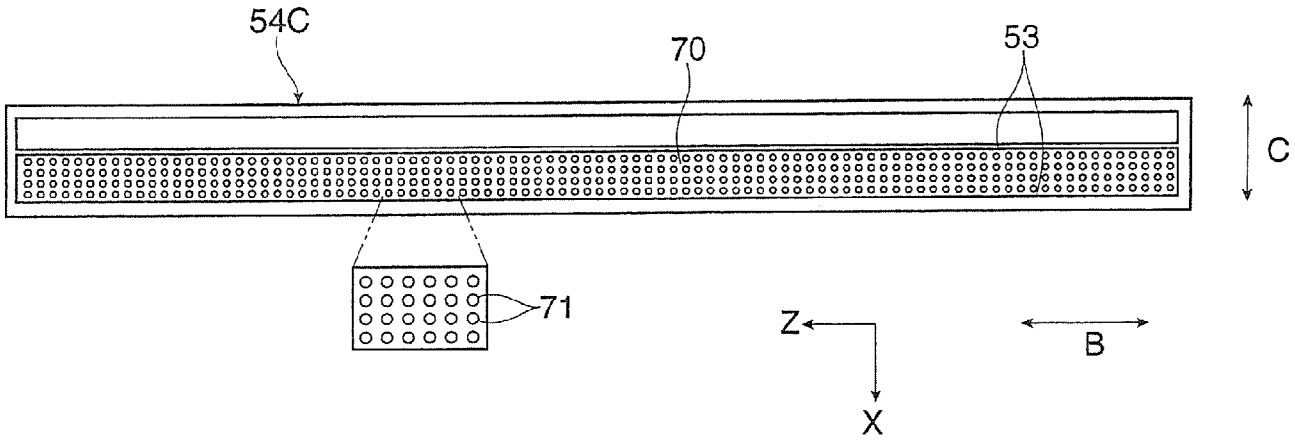
FIG. 6 schematically illustrates the blower device in FIG. 3, as viewed from below (i.e., from an outlet)

As shown in, for example, FIGS. 4 and 6, the second suppressing section 62 in the blower duct 51A is provided as a suppressing section that blocks the outlet 53 by using an air permeable member 70 having multiple air permeable sections 71.

The multiple air permeable sections 71 are linearly-extending through-holes each having a substantially circular opening shape. For example, the multiple air permeable sections 71 are arranged at regular pitch in the longitudinal direction B of the opening shape of the outlet 53 and are also arranged at pitch equal to the regular pitch in a lateral direction C orthogonal to the longitudinal direction B so as to form multiple rows (e.g., seven rows). Specifically, the multiple air permeable sections (holes) 71 are substantially uniformly arranged in the entire region of the outlet 53. Accordingly, the air permeable member 70 having the multiple air permeable sections 71 arranged therein is a porous plate having the multiple air permeable sections (holes) 71 arranged in a plate-shaped member.

For example, the air permeable member 70 constituting the second suppressing section 62 may be obtained by integral molding using the same material as the blower duct 51A or may be attached to the blower duct 51A after being formed using a material different therefrom. The opening shape, the opening dimensions, the hole length, and the hole density of the air permeable sections (holes) 71 are selected and set in view of making the flow speed of air flowing out from the second bent path section 54C via the outlet 53 uniform as much as possible, and are also set in view of the dimensions (capacities) of the paths TS in the blower duct 51A and the flow rate per unit time of air to be blown to the blower duct 51A or the charging device 4.

Operation of Blower Device

The operation of the blower device 5 (i.e., operation arising from the blower duct 51A) will be described below.

In the blower device 5, when a drive setting timing is reached, such as at the time of image forming operation, the blower 50 is first rotationally driven so as to deliver a predetermined amount of air. The air (E) delivered from the activated blower 50 is taken in through the inlet 52 of the blower duct 51A via the connection duct 55, and flows first into the path TS1 of the entrance path section 54A (FIG. 5).

Figure 9:
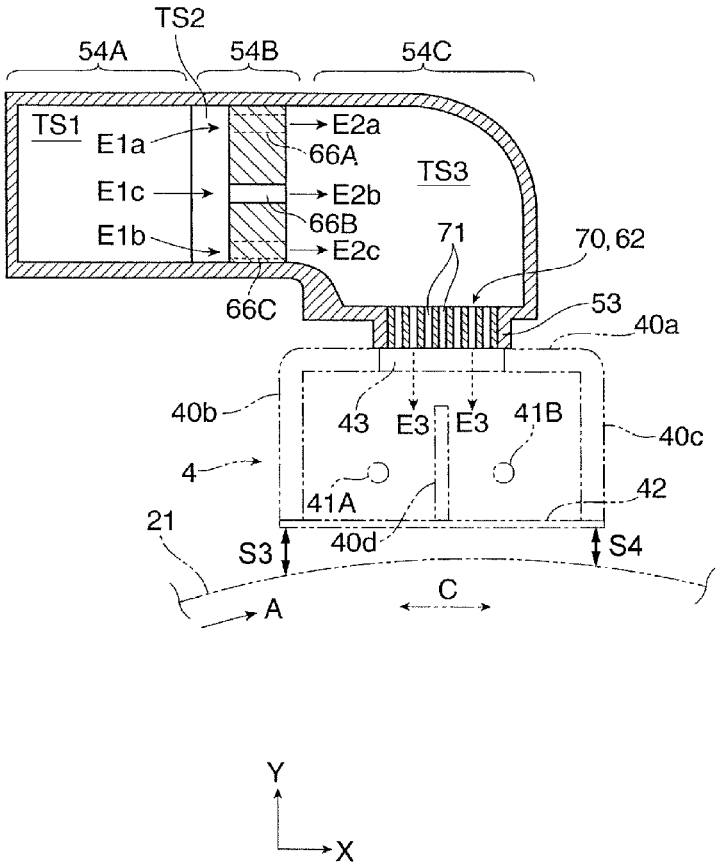
FIG. 9 illustrates the operational state of the blower device in FIG. 3.

Subsequently, as shown in FIGS. 5 and 9, the air (E) taken into the blower duct 51A travels through the path TS1 of the entrance path section 54A. While traveling through the path TS1 or after turning around by hitting against the closed end of the path TS1, the air (E) curves so that the traveling direction thereof changes, whereby the air (E) is caused to flow into the path TS2 of the first bent path section 54B. A portion of the air (E1) delivered to the path TS2 of the first bent path section 54B is blocked by the blocking portion 65 of the first suppressing section 61, whereas the remaining portion (e.g., see arrows E1*a*, E1*b*, and Etc in FIG. 5) travels and passes through the three openings 66A to 66C in the first suppressing section 61.

In this case, the air (E1) reaching the first suppressing section 61 is distributed to the three openings 66A to 66C disposed at different positions in the longitudinal direction D of the cross-sectional shape of the path TS2 in the first bent path section 54B and located at predetermined height positions h1, h2, and h3 with different heights H from the reference base surface 54*d* of the path TS2. Furthermore, when passing through the three openings 66A to 66C, the air (E1*a*, E1*b*, and E1*c*) increases in pressure by passing through the three openings 66A to 66C that have relatively narrower opening areas than the cross-sectional area of the cross-sectional shape of the path TS2 in the first bent path section 54B. Ultimately, the air (E1*a*, E1*b*, and E1*c*) flows out from the openings 66A to 66C.

Subsequently, the air (E2*a*, E2*b*, and E2*c*) passing through the three openings 66A to 66C and flowing into the path TS3 of the second bent path section 54C travels linearly through the path TS3 or temporarily moves in a circulating manner therein and subsequently travels toward the outlet 53 located at the terminal end (i.e., the lower end) of the path TS3 of the second bent path section 54C bent downward from the first bent path section 54B.

In this case, the air (E2*a*, E2*b*, and E2*c*) passing through the three openings 66A to 66C and flowing into the path TS3 of the second bent path section 54C flows through different positions in the path TS3 (and also in the remaining portion of the path TS2 to be precise) from the three openings 66A to 66C disposed at different positions, as described above. Moreover, in this case, the air (E2*a*, E2*b*, and E2*c*) flowing into the path TS3 of the second bent path section 54C flows into the downstream path TS3 having a capacity larger than those of the three openings 66A to 66C in the first suppressing section 61 so as to travel distributively through the path TS3 and to partially turn therein. Thus, a portion of the air is temporarily retained within the path TS3 in a circulating manner, so that unevenness in flow speed may be reduced.

Finally, a portion of the air (E2*a*, E2*b*, and E2*c*) flowing into the path TS3 of the second bent path section 54C passes through the multiple air permeable sections (holes) 71 in the air permeable member 70 of the second suppressing section 62 provided at the outlet 53, as indicated by arrows E3 in FIG. 9, so as to be blown out from the outlet 53.

In this case, the air (E3) blown out from the outlet 53 passes through the multiple air permeable sections 71 in the air permeable member 70, which has a relatively narrower opening area than the path TS3 of the second bent path section 54C or the outlet 53, so that the flow of the air (E3) is suppressed, whereby the air (E3) is blown out in a pressure-increased state.

Accordingly, the air (E3) is ejected from the outlet 53 of the blower duct 51A in a state where the flow speed thereof is substantially uniform in the longitudinal direction B and the lateral direction C of the rectangular opening shape of the outlet 53. Furthermore, even in a case where the amount of air taken in through the inlet 52 is particularly increased in the blower duct 51A, the air (E3) is ejected from the outlet 53 in a state where the flow speed thereof is substantially uniform in the longitudinal direction B of the outlet 53 and in a state where unevenness in the flow speed is reduced in the lateral direction C of the outlet 53. The above-described case where the amount of air taken in is increased is, for example, when a flow rate of 0.27 $m^3$/minute is increased to a flow rate of 0.33 $m^3$/minute.

Then, as shown in FIG. 9, the air (E3) ejected from the outlet 53 of the blower duct 51A in the blower device 5 is blown into the shield case 40 via the air inlet opening 43 in the shield case 40 of the charging device 4 and is subsequently blown onto the corona discharge wires 41A and 41B, which are located within spaces (see S1 and S2 in FIG. 4) partitioned from each other by the partition 40*d* in an internal space S of the shield case 40, and the grid electrode 42 located at the lower opening of the shield case 40.

With regard to the air blown onto the corona discharge wires 41A and 41B and the grid electrode 42, since the air (E3) is ejected at a substantially uniform flow speed in the longitudinal direction B and the lateral direction C of the opening shape of the outlet 53 of the blower duct 51A, as described above, the air is blown onto the corona discharge wires 41A and 41B and the grid electrode 42 in a substantially uniform state in the longitudinal direction B thereof, and is also blown onto the two corona discharge wires 41A and 41B in a substantially uniform state.

Accordingly, waste, such as paper particles, external additives in the toner, and discharge products, which may adhere to the two corona discharge wires 41A and 41B and the grid electrode 42 in the charging device 4, may be kept distant therefrom by blowing air uniformly thereto.

As a result, in the charging device 4, the occurrence of a degradation phenomenon, such as uneven discharge performance (electrostatic charging performance) caused by sparse adhesion of waste onto the corona discharge wires 41A and 41B and the grid electrode 42, may be prevented, so that the peripheral surface of the photoconductor drum 21 may be electrostatically charged more uniformly (along the rotation axis thereof).

First Test

Figure 10:
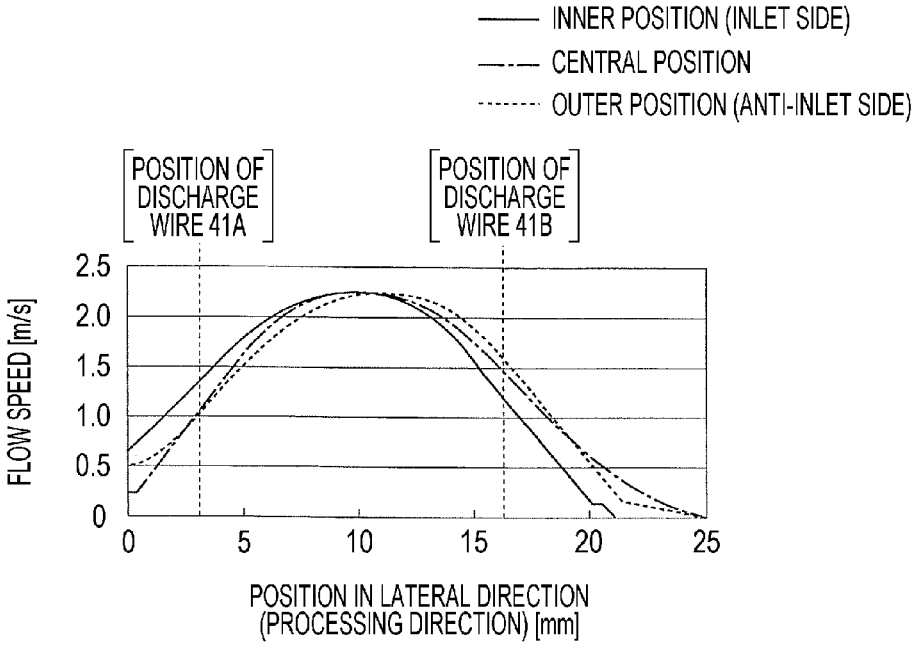
FIG. 10 is a graph illustrating a result of a first test related to the characteristics of the blower duct according to the exemplary embodiment.

FIG. 10 illustrates a result of a first test performed for studying the performance characteristics of the blower device 5 (i.e., flow speed distribution in the lateral direction of air ejected from the blower duct 51A).

In the first test, the flow speed of air blown out from the outlet 53 of the blower duct 51A is measured based on simulation under the following conditions when a relatively large average amount of air, namely, about 0.33 $m^3$/minute, is introduced by the blower 50 through the inlet 52 of the blower duct 51A having the configuration below.

As shown in FIGS. 5 and 9, the flow speed is measured at three measurement positions in the longitudinal direction B of the outlet 53, namely, an inner position (i.e., an end position closer toward the inlet 52), a substantially central position, and an outer position (i.e., an end position farther away from the inlet 52). At each measurement position, the state of flow speed in the internal space S of the shield case 40 of the charging device 4 from an upstream end position (i.e., the inner wall surface of the side plate 40*b*) to a downstream end position (i.e., the inner wall surface of the side plate 40*c*) in the rotational direction A of the photoconductor drum 21 is studied.

The blower duct 51A used has the path section 54 having the overall shape shown in FIGS. 3 to 6. The inlet 52 has a substantially square opening shape of 23 mm by 22 mm (i.e., a rectangular shape that is slightly longer in the vertical direction). The outlet 53 has a narrow rectangular opening shape of 350 mm in the longitudinal direction B by 17.5 mm in the lateral direction C. The path TS2 of the first bent path section 54B has a rectangular cross-sectional shape with a width W of 354 mm and a height H of 8 mm. The total capacity of the paths TS1 to TS3 in the blower duct 51A is about 170 $cm^3$.

The first suppressing section 61 in the blower duct 51A is provided such that the inner wall surface 65*a* at the upstream side of the blocking portion 65 is located in an area where the displacement amount N from the end 52*a* of the inlet 52 in the path TS2 of the entrance path section 54A is 6 mm (FIG. 4).

The blocking portion 65 of the first suppressing section 61 has a thickness (i.e., the path length M of the openings 66) of 8 mm.

The three openings 66A to 66C in the first suppressing section 61 each have a rectangular opening shape with a length (La, Lb, Lc) of 120 mm and a height (Ka, Kb, Kc) of 2 mm. With reference to the overall height H (8 mm) of the path TS2, the first opening 66A is disposed at the first height position h1 of 6.7 mm, the second opening 66B is disposed at the second height position h2 of 4 mm, and the third opening 66C is disposed at the third height position h3 of 1 mm. In particular, the third opening 66C is disposed such that the lower plane thereof is aligned with the base surface 54*d*. Moreover, the first opening 66A and the third opening 66C are disposed to have a positional relationship such that the overlapping amount J1 of the adjoining ends thereof is 3 mm. The second opening 66B and the third opening 66C are disposed to have a positional relationship such that the overlapping amount J2 of the adjoining ends thereof is 3 mm.

Furthermore, with regard to the second suppressing section 62 in the blower duct 51A, the porous air permeable member 70 provided with the air permeable sections (holes) 71 with a hole diameter of 1 mm and a length of 3 mm and at a density of 0.42 holes/$mm^2$ (≈42 holes/$cm^2$) is used.

It is clear from the result shown in FIG. 10 that the flow speed in the lateral direction C of the outlet 53 of the blower duct 51A is substantially identical at three positions in the longitudinal direction B (i.e., the aforementioned three measurement positions) of the outlet 53 and that unevenness in flow speed in the lateral direction C may be reduced even when the amount of air taken in through the inlet 52 is increased. The value of "0 mm" on the abscissa axis in FIG. 10 substantially corresponds to the position of the inner wall surface of the side plate 40*b* located at the upstream side of the shield case 40 in the rotational direction A of the photoconductor drum 21.

Figure 17:
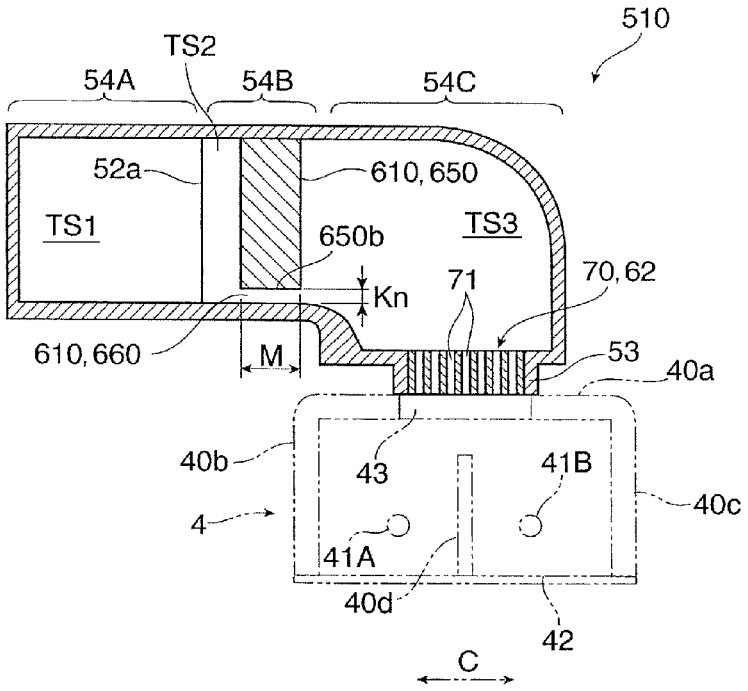
FIG. 17 is a cross-sectional view schematically illustrating a blower duct of a comparative example.

For a comparison, the first test described above is similarly performed by using a blower duct 510 provided with a first suppressing section 610 shown in FIG. 17

Comparative Example

The blower duct 510 of the comparative example is configured by providing the following first suppressing section 610 in place of the first suppressing section 61 in the above-described blower duct 51A according to the exemplary embodiment.

Figure 18:
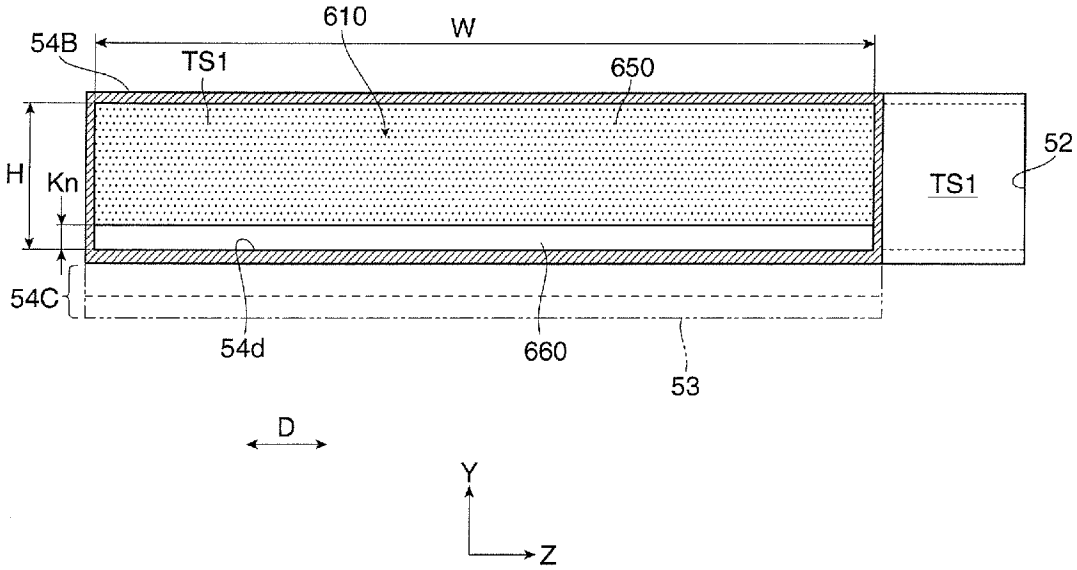
FIG. 18 is an enlarged view of a first suppressing section in the blower duct of the comparative example.

As shown in FIGS. 17 and 18, the first suppressing section 610 of the comparative example is configured by disposing a blocking member, which forms a blocking portion 650 within the path TS2 of the first bent path section 54B, in a traversing manner such that the blocking member is spaced apart from the base surface 54*d* in the cross-sectional shape of the path TS2 by a predetermined gap (opening) 660. The opening 660 is a gap having a rectangular opening shape with a length equal to the width W (=345 mm) of the path TS2 and a height Kn of 1.5 mm. The opening 660 has a path length M equal to the path length M of the openings 66 in the exemplary embodiment.

Figure 19:
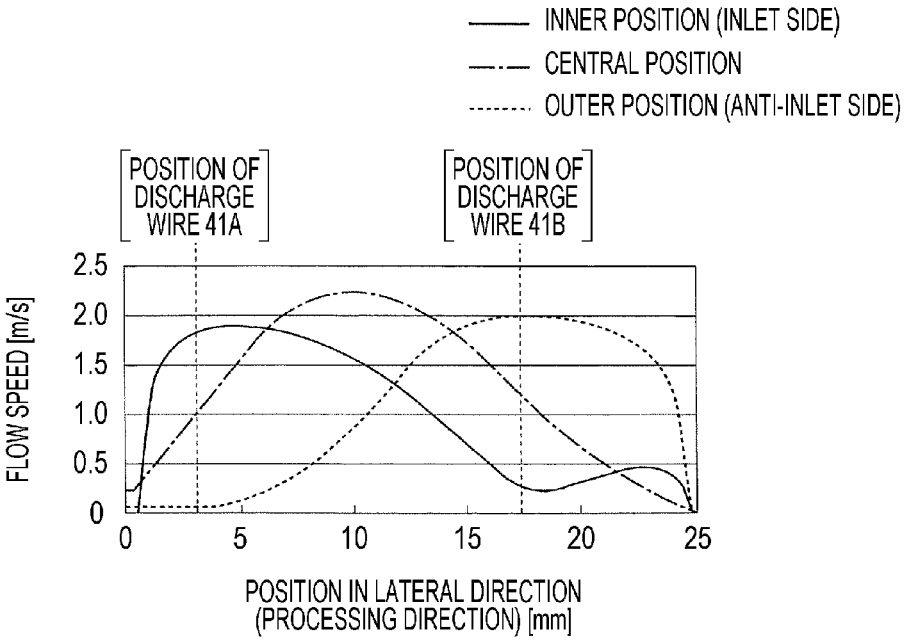
FIG. 19 is a graph illustrating a result of the first test related to the characteristics of the blower duct of the comparative example.

FIG. 19 illustrates a result of the first test performed using the blower duct 510 of this comparative example. It is clear from the result of this first test that the flow speed in the lateral direction C of the outlet 53 of the blower duct 510 varies greatly at three positions in the longitudinal direction B (i.e., the aforementioned three measurement positions) of the outlet 53 and that unevenness in flow speed in the lateral direction C is prominent when the amount of air taken in through the inlet 52 is increased.

In contrast, in the blower device 5 equipped with the blower duct 51A according to the exemplary embodiment, a good result with reduced unevenness in flow speed in the lateral direction C of the outlet 53 may be obtained, as shown in FIG. 10.

Second Test

Figure 11:
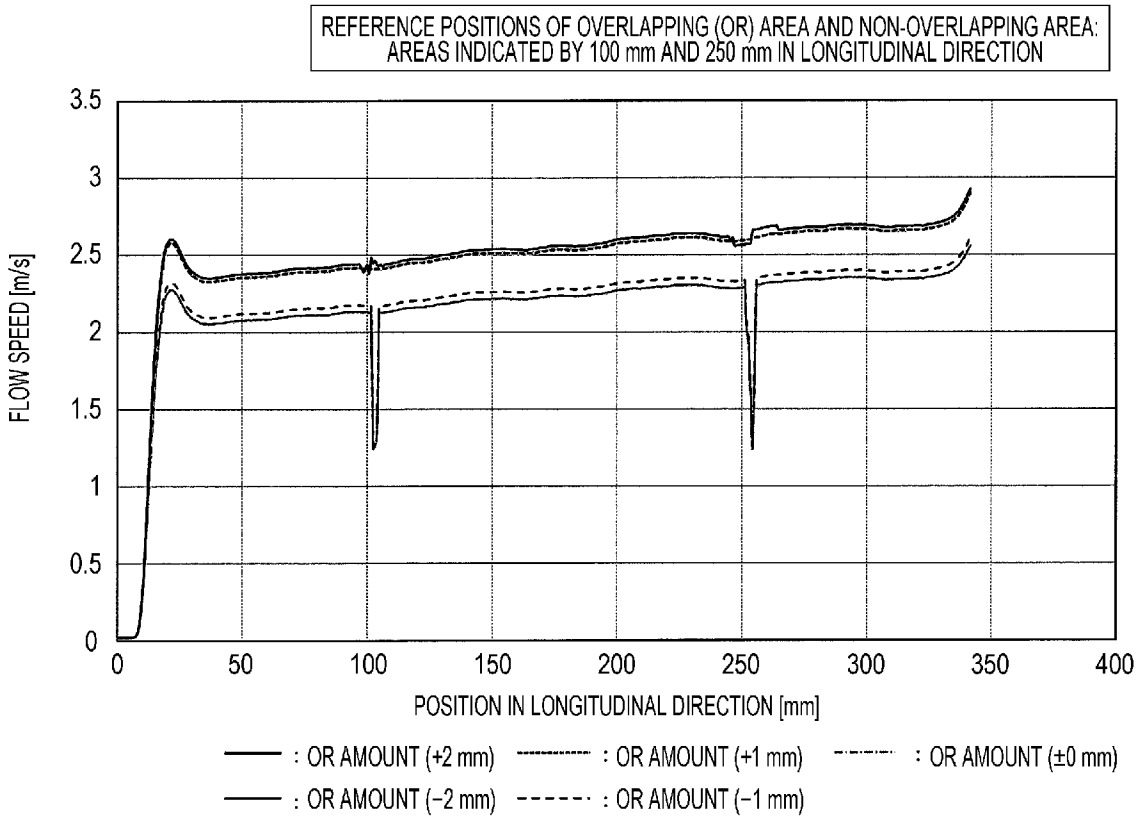
FIG. 11 is a graph illustrating a result of a second test related to the characteristics of the blower duct according to the exemplary embodiment.

FIG. 11 illustrates a result of a second test performed for studying other performance characteristics of the blower device 5 (i.e., flow speed distribution, in the longitudinal direction, of air ejected from the blower duct 51A).

In the second test, blower ducts each prepared as the blower duct 51A have set therein different values shown in FIG. 11 for the overlapping amounts (J1 and J2) of the three openings 66A to 66C in the first suppressing section 61, and the flow speed of air ejected from the outlet 53 of each blower duct is measured based on simulation under the following conditions.

The flow speed is measured by studying the state of flow speed in the entire region in the longitudinal direction B of the outlet 53 of each blower duct. The measurement position is the substantially central position in the lateral direction C of the outlet 53. An average amount of air taken in through the inlet 52 is set to the same value as in the first test. The 0-mm position on the abscissa axis in FIG. 11 is a position (i.e., an inner position) close to the inlet 52.

It is clear from the result shown in FIG. 11 that, in the case where the three openings 66A to 66C have positional relationships such that the ends of adjoining openings partially overlap each other (i.e., in the case where the overlapping amount is +1 mm or +2 mm), unevenness in flow speed in the longitudinal direction B of the outlet 53 in each blower duct 51A may be reduced in the entire region in the longitudinal direction B. Furthermore, because a result obtained when the overlapping amount is ±0 mm is substantially the same as the result obtained when the overlapping amount is +1 mm, the result corresponding to the overlapping amount of ±0 mm substantially matches the result corresponding to the overlapping amount of +1 mm in FIG. 11, and it is difficult to distinguish them from each other. Therefore, in a case where the three openings 66A to 66C have positional relationships such that the ends of adjoining openings are aligned with each other (i.e., in a case where the overlapping amount is 0 mm), a good result substantially the same as the case where the overlapping amount is +1 mm is obtained.

On the other hand, in a case where the three openings 66A to 66C have positional relationships such that the ends of adjoining openings are disposed away from each other (i.e., in a case where the overlapping amount is −1 mm or −2 mm), it is clear that unevenness occurs that causes the flow speed to relatively decrease in the overlapping areas (i.e., two areas) in the longitudinal direction B.

Third Test

Figure 12A:
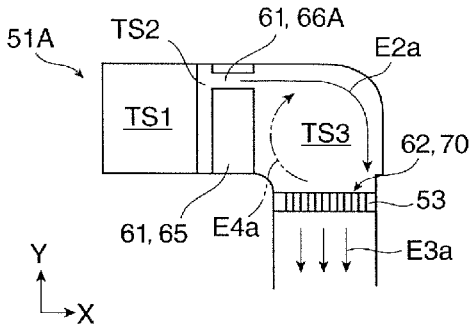
FIGS. 12A to 12C illustrate a result of a third test related to the characteristics of the blower duct according to the exemplary embodiment.
Figure 12B:
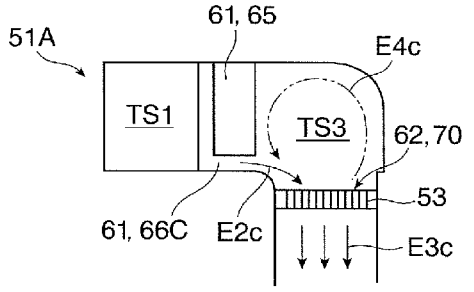
Figure 12C:
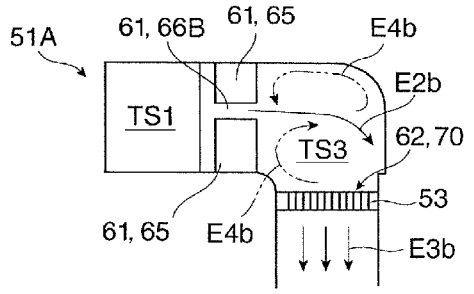

FIGS. 12A to 12C illustrate a result of a third test performed for studying the performance characteristics of the blower device 5 (i.e., the direction of air when ejected from the outlet 53 of the blower duct 51A).

The third test is a simulation-based study of the flowing state of air passing through the openings 66A to 66C of the first suppressing section 61 in the blower duct 51A and ejected from the outlet 53 where the second suppressing section 62 is provided, when the first test is performed using the blower duct 51A according to the exemplary embodiment employed in the first test. FIGS. 12A to 12C schematically illustrate the contour of the path TS, the outlet 53, and the two suppressing sections 61 and 62 in the blower duct 51A. Furthermore, of information about the air flowing state obtained based on simulation, each of FIGS. 12A to 12C only illustrates the air flowing state indicating the characteristic features.

It is clear from the result shown in FIGS. 12A to 12C that the air (E3*a*, E3*b*, and E3*c*) passing through the openings 66A to 66C of the first suppressing section 61 is ejected from the outlet 53 in a substantially uniform state in a direction substantially orthogonal to the opening plane of the outlet 53.

Figure 20A:
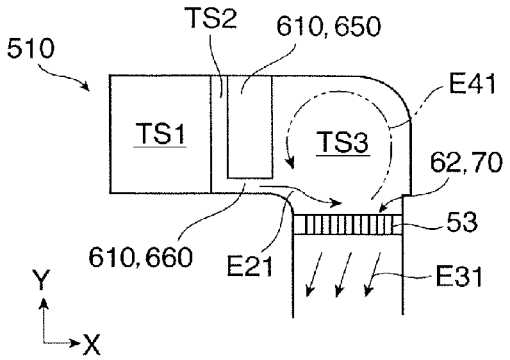
FIGS. 20A to 20C illustrate a result of the third test related to the characteristics of the blower duct of the comparative example.
Figure 20B:
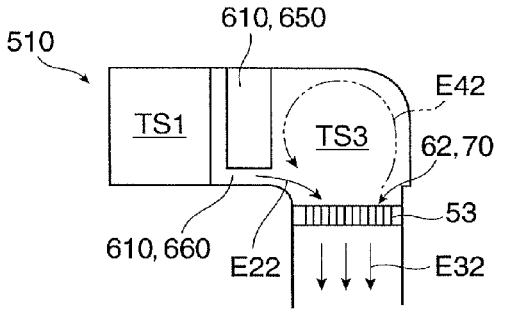
Figure 20C:
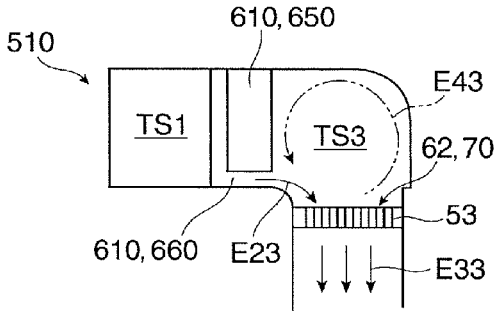

In contrast, FIGS. 20A to 20C illustrate a result obtained when the state of air passing through the opening 660 of the first suppressing section 610 and ejected from the outlet 53 is simulated as a third test by using the blower duct 510 of the comparative example described above in the first test.

It is clear from the result shown in FIGS. 20A to 20C that, with regard to the air (E31, E32, and E33) passing through the single opening 660 of the first suppressing section 610 and ejected from the outlet 53, especially the air (E31 and E33) ejected from the inner side and the outer side in the longitudinal direction B of the outlet 53 is ejected in a slightly inclined direction instead of the direction orthogonal to the opening plane of the outlet 53. It is assumed that this phenomenon occurs due to the flow speed of the air (E21 and E23) flowing out via the inner and outer positions of the opening 660 being lower than or higher than that of the air (E22) flowing out via the central position of the opening 660. It is conceived that this phenomenon is one of the factors causing unevenness in flow speed in the lateral direction C (particularly, between the end regions, in the lateral direction C, where the corona discharge wires 41A and 41B are disposed) indicated in the result of the comparative example (FIG. 19) in the first test.

In the case of the blower duct 51A according to the exemplary embodiment, as shown in FIG. 12A, the air (E2*a*) passing through the first opening 66A flows out to an upper position in the height direction of the path TS3 of the second bent path section 54C, moves along the upper inner wall surface thereof, and then flows downward in a bent manner toward the outlet 53. A portion (E4*a*) of the air (E2*a*) is not ejected from the outlet 53 (i.e., the second suppressing section 62) but flows upward in a circulating manner within the path TS3.

The flow speed of air that is to pass through the end region close to the inlet 52 in the longitudinal direction D of the first suppressing section 61 becomes the lowest due to the effect of, for example, separation of air occurring in the bent area of the path TS, and the speed of the air when being ejected from the outlet 53 tends to relatively decrease in an outer passing region (i.e., the end region at the corona discharge wire 41B side) in the lateral direction C, particularly, in the bending direction, of the second bent path section 54C (for example, see the result of the inner position in FIG. 19).

In the case where the first opening 66A located closest to the inlet 52 is disposed at the first height position h1 that is higher than those of the other openings 66B and 66C in the first suppressing section 61, as in the first exemplary embodiment, a portion (E2*a*) of the air passing through the first opening 66A flows directly toward the outlet 53, as shown in FIG. 12A. As a result, the speed of air when being ejected from the outlet 53 increases especially in the outer passing region in the lateral direction C, so that it is assumed that the speeds in both end regions, in the lateral direction C, where the corona discharge wires 41A and 41B are disposed are corrected to substantially similar speeds (see the result of the inner position in FIG. 10).

Furthermore, in the case of the blower duct 51A according to the exemplary embodiment, as shown in FIG. 12C, the air (E2*b*) passing through the second opening 66B flows out to the substantially central position in the height direction of the path TS3 of the second bent path section 54C and flows to impinge against the inner wall surface of the path TS3. Moreover, by impinging against the inner wall surface, the air (E2*b*) becomes air (E4*b*) that flows separately in a circulating manner through an upper portion and a lower portion of the path TS3.

The flow speed of air that is to pass through the end region farthest from the inlet 52 in the longitudinal direction D of the first suppressing section 61 becomes the highest since an air flow is also generated after the air impinges against the inner wall surface opposite from the inlet 52 in the entrance path section 54A without being affected by, for example, separation of air occurring in the bent area of the path TS, and the speed of the air when being ejected from the outlet 53 tends to decrease in an inner passing region (i.e., the end region at the corona discharge wire 41A side) in the lateral direction C, particularly, in the bending direction, of the second bent path section 54C and relatively increase in the outer passing region in the bending direction (for example, see the result of the outer position in FIG. 19).

Because the second opening 66B located farthest from the inlet 52 in the first suppressing section 61 is disposed at the intermediate height position h2, which is relatively the second highest position, in the first exemplary embodiment, the air (E2*b*) passing through the second opening 66B impinges against the inner wall surface facing the third path TS3, as shown in FIG. 12C, so as to separate into two upper and lower circulating air flows (E4*b*). As a result, the speed of air in the lateral direction C when being ejected from the outlet 53 is increased in the inner passing region but is reduced in the outer passing region, so that it is assumed that the speeds in both end regions, in the lateral direction C, where the corona discharge wires 41A and 41B are disposed are adjusted to substantially similar speeds that are balanced as a whole.

Furthermore, in the case of the blower duct 51A according to the exemplary embodiment, as shown in FIG. 12B, the air (E2*c*) passing through the third opening 66C flows out to the lower position in the height direction of the path TS3 of the second bent path section 54C and flows to traverse the outlet 53 (i.e., the second suppressing section 62). Moreover, a portion (E4*c*) of the air (E2*c*) passes by the outlet 53 (i.e., the second suppressing section 62) and subsequently rises within the path TS3 so as to flow in a circulating manner therein.

The flow speed of air that is to pass through the central region in the longitudinal direction D of the first suppressing section 61 is much the same in both end regions, in the lateral direction C, where the corona discharge wires 41A and 41B are disposed, as compared with the speed of air that is to pass through the position closest to the inlet 52 and the speed of air that is to pass through the position farthest from the inlet 52 (for example, see the result of the central position in FIG. 19).

By disposing the third opening 66C, located at the central position in the longitudinal direction D of the first suppressing section 61, at relatively the lowest position h3, as in the first exemplary embodiment, the air (E2*c*) passing through the third opening 66C flows straight through the aforementioned inner passing region in the lateral direction C without traveling through the outlet 53 (i.e., the air permeable sections 71 of the second suppressing section 62 in actuality). However, in the inner passing region in the lateral direction C, the air (E4*c*) turning upward by impinging against the inner wall surface facing the path TS3, as shown in FIG. 12B, presses the air (E2*c*) from above. As a result, it is assumed that the speed of air in the lateral direction C when being ejected from the outlet 53 is maintained at further similar speeds in both end regions, in the lateral direction C, where the corona discharge wires 41A and 41B are disposed.

In the blower duct 51A according to the exemplary embodiment, the air immediately after passing through the openings 66A to 66C located at different positions in the longitudinal direction D of the first suppressing section 61 vary in flowing speeds. However, in the blower duct 51A according to the exemplary embodiment, the heights h of the openings 66A to 66C are set to have predetermined height relationships so that the air flowing into the path TS3 by passing through the openings 66A to 66C is varied in flows, whereby the flow speed of air in the lateral direction C after ultimately passing through the outlet 53 (particularly, the end regions, in the lateral direction C, where the corona discharge wires 41A and 41B are disposed) may be improved to a uniform state with reduced unevenness.

Other Exemplary Embodiments

In the first exemplary embodiment, the three openings 66A to 66C are provided as the first suppressing section 61 of the blower duct 51A. Alternatively, for example, a first suppressing section 61B or 61C having the configuration shown in FIG. 13 or 14 may be employed as the first suppressing section 61.

Figure 13:
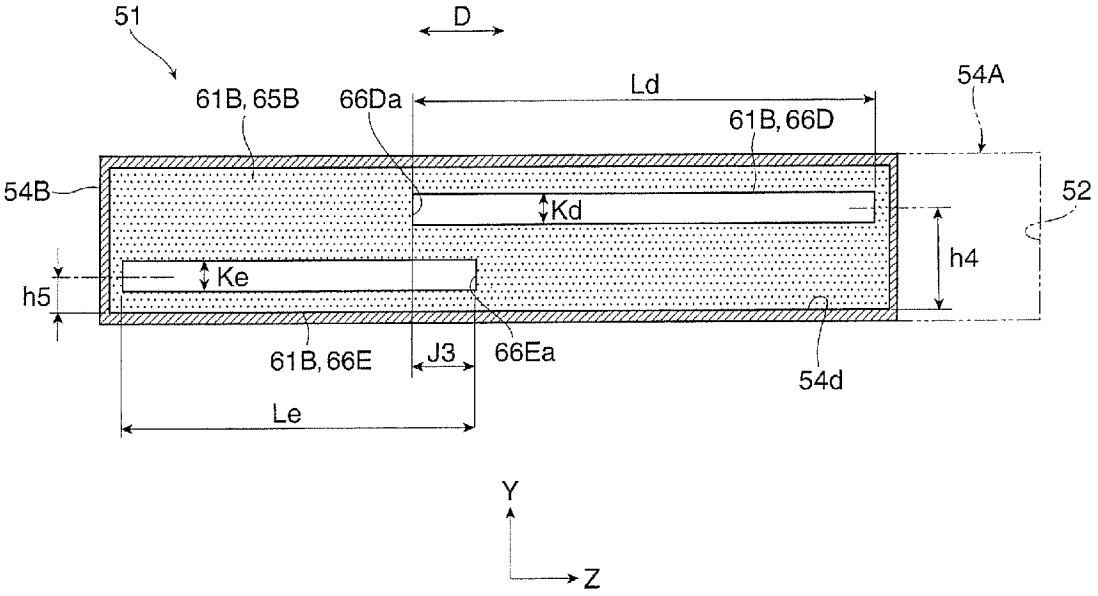
FIG. 13 is an enlarged view illustrating another configuration example of the first suppressing section.

The first suppressing section 61B shown in FIG. 13 includes a blocking portion 65B and two openings 66D and 66E. The blocking portion 65B is a region excluding the two openings 66D and 66E in a cross-sectional region in the longitudinal direction D of the path TS2 of the first bent path section 54B.

The two openings 66D and 66E include a first opening 66D disposed at a position closest to the inlet 52 in the longitudinal direction D of the path TS2 of the first bent path section 54B and a second opening 66E disposed farthest from the inlet 52. The first opening 66D has a rectangular opening shape that is long in the longitudinal direction D and has a length Ld and a height Kd. The second opening 66E has a rectangular opening shape that is long in the longitudinal direction D and has a length Le and a height Ke. The openings 66D and 66E may both have a path length M that is equal to the path length of each opening 66 in the first exemplary embodiment. Furthermore, the openings 66D and 66E may have identical lengths Ld and Le and identical heights Kd and Ke, or may have different lengths Ld and Le and different heights Kd and Ke. Moreover, the lengths Ld and Le and the heights Kd and Ke are set to be larger than the lengths La, Lb, and Lc and the heights Ka, Kb, and Kc of the three openings 66A to 66C in the first exemplary embodiment.

Furthermore, the first opening 66D is disposed at a first height position h4, which is where the height from the reference base surface 54*d* of the path TS2 is the largest. The second opening 66E is disposed at a second height position h5 (<h4), which is where the height from the reference base surface 54*d* is the second largest.

Moreover, the first opening 66D and the second opening 66E are disposed at different positions in the longitudinal direction D. In addition, the first opening 66D and the second opening 66E are disposed to have a positional relationship such that an end 66Da and an end 66Ea, which adjoin each other, overlap each other by a predetermined overlapping amount J3. This overlapping amount J3 is set to be larger than the overlapping amounts J1 and J2 of the three openings 66A to 66C in the first exemplary embodiment.

Figure 14:
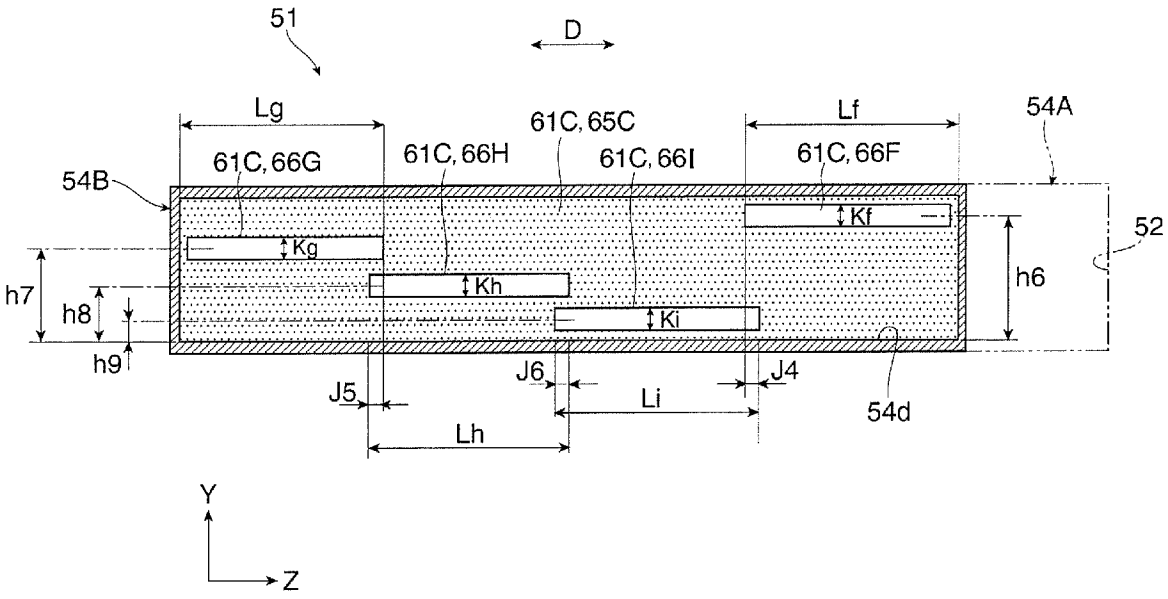
FIG. 14 is an enlarged view illustrating another configuration example of the first suppressing section.

The first suppressing section 61C shown in FIG. 14 includes a blocking portion 65C and four openings 66F, 66G, 66H, and 66I. The blocking portion 65C is a region excluding the four openings 66F, 66G, 66H, and 66I in a cross-sectional region in the longitudinal direction D of the path TS2 of the first bent path section 54B.

The four openings 66 (66F to 66I) include a first opening 66F disposed closest to the inlet 52 in the longitudinal direction D of the path TS2 of the first bent path section 54B, a second opening 66G disposed farthest from the inlet 52, and remaining third and fourth openings 66H and 66I disposed at least between the first opening 66F and the second opening 66G.

The first opening 66F has a rectangular opening shape that is long in the longitudinal direction D and has a length Lf and a height Kf. The second opening 66G has a rectangular opening shape that is long in the longitudinal direction D and has a length Lg and a height Kg. The remaining third opening 66H has a rectangular opening shape that is long in the longitudinal direction D and has a length Lh and a height Kh. The other remaining fourth opening 66I has a rectangular opening shape that is long in the longitudinal direction D and has a length Li and a height Ki. The four openings 66F, 66G, 66H, and 66I may have identical lengths Lf, Lg, Lh, and Li and identical heights Kf, Kg, Kh, and Ki, or may have different lengths Lf, Lg, Lh, and Li and different heights Kf, Kg, Kh, and Ki. The lengths Lf, Lg, Lh, and Li and the heights Kf, Kg, Kh, and Ki are set to be smaller than the lengths La, Lb, and Lc and the heights Ka, Kb, and Kc of the three openings 66A to 66C in the first exemplary embodiment.

Furthermore, the first opening 66F is disposed at a first height position h6, which is where the height from the reference base surface 54*d* of the path TS2 is the largest. The second opening 66G is disposed at a second height position h7 (<h6), which is where the height from the reference base surface 54*d* is the second largest. The remaining third opening 66H is disposed at a third height position h8 (<h7), which is lower than the second height position h7 and is where the height from the reference base surface 54*d* is the third largest. The remaining fourth opening 66I is disposed at a fourth height position h9 (<h8), which is lower than the third height position h8 and is where the height from the reference base surface 54*d* is the fourth largest (i.e., the smallest).

Specifically, the remaining third and fourth openings 66H and 66I are disposed at respective height positions (h8>h9), which are lower than the second height position h7, such that the remaining opening disposed closer toward the inlet 52 in the longitudinal direction D of the cross-sectional shape of the path TS2 decreases in height H from the base surface 54*d* in a stepwise manner. This height-position relationship similarly applies to a case where there are three or more remaining openings.

Furthermore, the first opening 66F, the second opening 66G, and the remaining third openings 66H and 66I are disposed at different positions in the longitudinal direction D. In addition, the openings 66F, 66G, 66H, and 66I are disposed to have positional relationships such that adjoining ends thereof overlap each other by predetermined overlapping amounts J4, J5, and J6. The overlapping amounts J4, J5, and J6 are equal to or larger than the overlapping amounts J1 and J2 of the three openings 66A to 66C in the first exemplary embodiment.

The blower duct 51A in the first exemplary embodiment is provided with the path section 54 having the entrance path section 54A, the first bent path section 54B, and the second bent path section 54C. Alternatively, for example, a blower duct 51B provided with the entrance path section 54A and the first bent path section 54B, as shown in FIGS. 15 and 16, may be employed as the blower duct.

Figure 15:
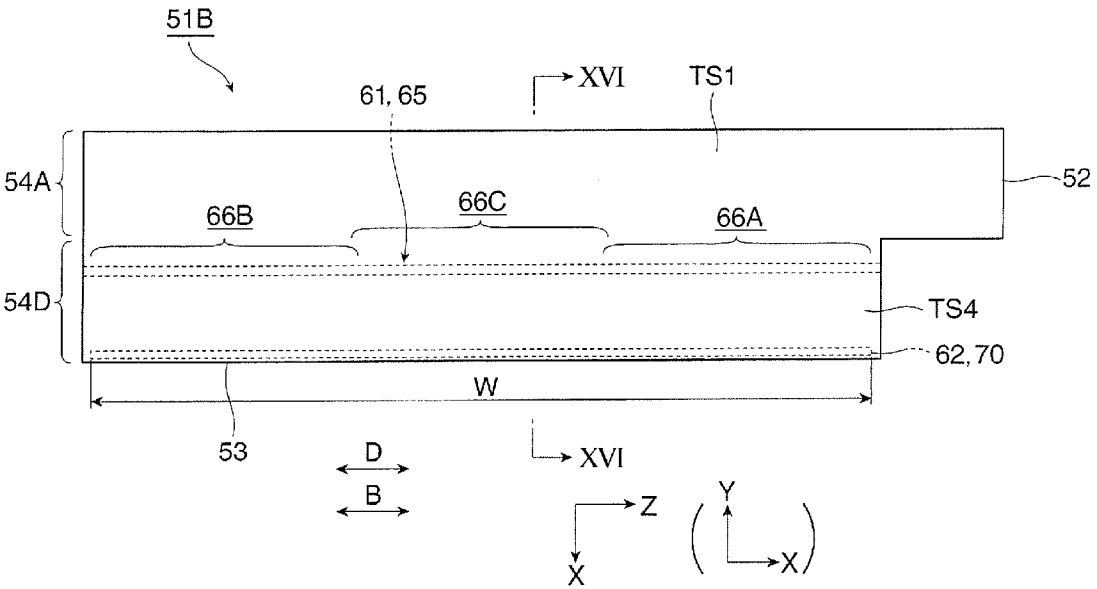
FIG. 15 schematically illustrates another configuration example of the blower duct, as viewed from above (or from a lateral direction)
Figure 16:
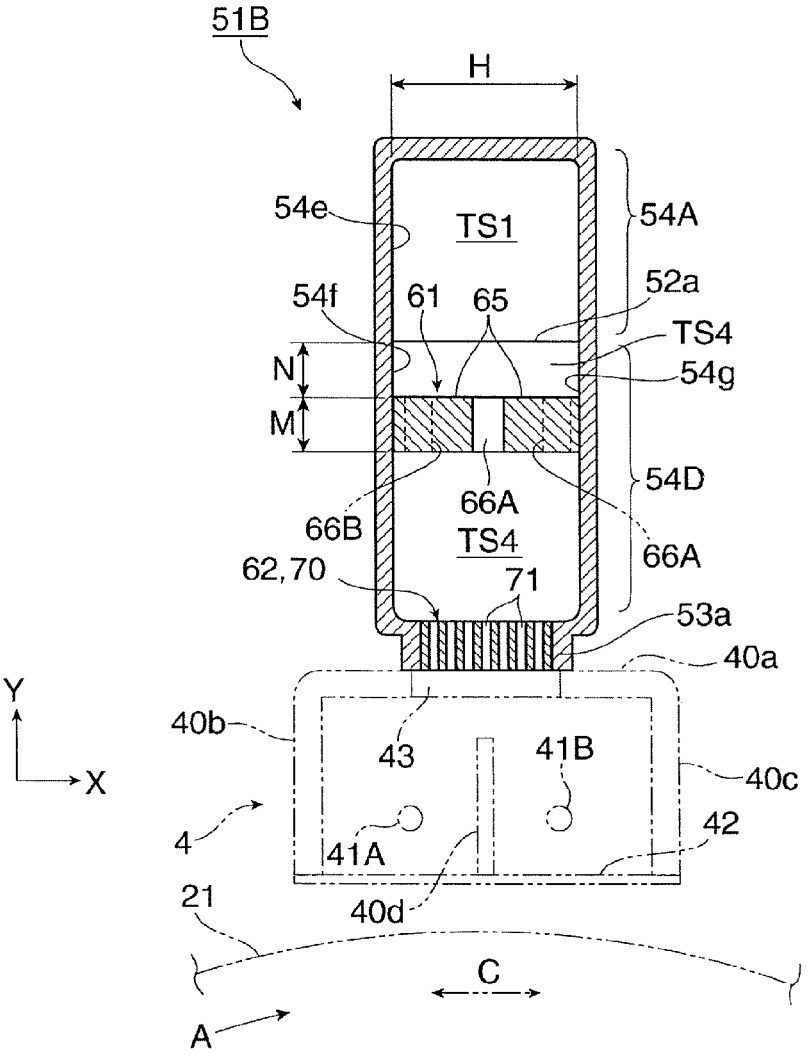
FIG. 16 is a cross-sectional view of the blower duct in FIG. 15, taken along line XVI-XVI.

As compared with the blower duct 51A according to the first exemplary embodiment, the blower duct 51B shown in FIGS. 15 and 16 does not have the second bent path section 54C that is bent in one direction (i.e., the downward direction) from the terminal end of the first bent path section 54B. Instead, the blower duct 51B has a new first bent path section 54D with a path TS4 that extends linearly after being bent in a manner similar to the second bent path section 54C in the first exemplary embodiment from an intermediate position of the entrance path section 54A and that has the outlet 53 located at the terminal end (surface). In this blower duct 51B, the outlet 53 located at the terminal end of the first bent path section 54D is provided with a second suppressing section 62 having a configuration similar to that in the first exemplary embodiment.

As the first suppressing section 61, this blower duct 51B is provided with a suppressing section including the blocking portion 65 and the three openings 66A to 66C, similar to the first suppressing section 61 in the first exemplary embodiment (see, for example, FIGS. 4, 7, and 8).

In this case, a reference base surface in the path TS4 of the first bent path section 54C serving as the reference for setting the height positions h (h1 to h3) of the three openings 66A to 66C may be the relatively wider one of opposing inner wall surfaces 54*f* and 54*g* among the inner wall surfaces constituting the path TS4. With regard to this reference base surface, for example, in a case where the blower duct 51B is used with the outlet 53 facing downward, as shown in FIG. 16, the inner wall surface 54*f* located at the upstream side in the rotational direction A of the photoconductor drum 21 electrostatically charged by the charging device 4 disposed below the blower duct 51B may serve as the "reference base surface".

Furthermore, in this blower duct 51B, the first suppressing section 61B (FIG. 13) or the first suppressing section 61C (FIG. 14) having the alternative configuration described above may be employed as the first suppressing section 61.

In the first exemplary embodiment, two suppressing sections, namely, the first suppressing section 61 and the second suppressing section 62, are provided for suppressing the flow of air in the blower duct. Alternatively, three or more suppressing sections may be provided. In this case, the blower duct is provided with the path section 54 having the path TS that is bent two or more times, and has an additional suppressing section disposed between the first suppressing section 61 and the second suppressing section 62. Furthermore, the suppressing sections, including the first suppressing section 61, may each be provided in an area where the cross-sectional shape changes in the path TS of the path section 54 of the blower duct or an area after (e.g., immediately after) the air flowing direction changes in the path TS.

Furthermore, the second suppressing section 62 provided at the outlet 53 of the blower duct 51A or 51B used in the blower device 5 is not limited to the configuration that uses the air permeable member 70 having the multiple air permeable sections (holes) 71 described in the first exemplary embodiment. For example, the second suppressing section 62 may use an alternative air permeable member 70 typified by a porous member (i.e., a member having multiple air permeable sections 71 with irregular shapes extending therethrough), such as a nonwoven fabric applied to, for example, a filter.

Furthermore, the charging device 4 to which the blower device 5 is applied may be a charging device of a type that does not have the grid electrode 42 installed therein, namely, a so-called corotron-type charging device. Moreover, the charging device 4 to which the blower device 5 (including the blower duct) is applied may be of a type that uses a single corona discharge wire 41 or three or more corona discharge wires 41. The corona discharger to which the blower device 5 is applied may be a corona discharger that removes electricity from the photoconductor drum 21 or a corona discharger that electrostatically charges or removes electricity from a rotating charge body other than the photoconductor drum 21. A discharge-target rotating member that experiences corona discharge by the corona discharger is not limited to a drum-type member and may be a belt-type member. Furthermore, the discharge-target rotating member used when corona discharge is performed by the corona discharger is not limited to a member whose portion that passes through a discharge opening has a curved surface with fixed curvature, but may be a member having a flat surface.

With regard to the image forming apparatus 1, the configuration thereof for, for example, image formation is not particularly limited so long as it is equipped with a long target structure to which the blower device 5 is applied (i.e., to which air is blown by the blower device 5). For example, although the image forming apparatus 1 uses a single image forming unit 20 to form a monochromatic image in the first exemplary embodiment, the image forming apparatus 1 may alternatively be of a type that forms a multicolor image by using multiple image forming units 20 that form images of different colors.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A blower duct comprising:

a path section having a path that connects an inlet and an outlet and allows air to flow through the path, the inlet taking in the air, the outlet ejecting the air taken in from the inlet and having an opening shape that is long in one direction; and a plurality of suppressing sections that are provided at different locations in a direction in which the air flows through the path of the path section and that suppress flow of the air, wherein the path section at least has an entrance path section and a first bent path section, the entrance path section having a path whose one end is provided with the inlet, the first bent path section being bent from an intermediate position of the entrance path section and having a path with a cross-sectional shape that is long in one direction, wherein one of the suppressing sections is a first suppressing section including a blocking portion and a plurality of openings, the blocking portion being disposed in a part of the path of the first bent path section and extending in the one direction of the cross-sectional shape so as to block the flow of the air, the plurality of openings each having an opening shape that is long in the one direction of the cross-sectional shape and being disposed at different positions in the one direction of the cross-sectional shape, and wherein the openings include a first opening that is disposed closest to the inlet in the one direction of the cross-sectional shape, the first opening being disposed at a first height position, which is where a height from a reference base surface of the path of the first bent path section is larger than the remaining one or more openings.

2. The blower duct according to claim 1, wherein the openings include a second opening that is disposed farthest from the inlet in a longitudinal direction of the cross-sectional shape, the second opening being disposed at a second height position, which is where the height from the base surface is second largest.

3. The blower duct according to claim 2, wherein the openings include a remaining opening disposed at least between the first opening and the second opening, the remaining opening being disposed at a third height position that is lower than the second height position.

4. The blower duct according to claim 3, wherein the remaining opening includes a plurality of remaining openings, and wherein the remaining openings are disposed at respective height positions such that the remaining opening disposed closer toward the inlet in the longitudinal direction of the cross-sectional shape decreases in height from the base surface in a stepwise manner within the third height position.

5. The blower duct according to claim 1, wherein the plurality of openings are disposed to have a positional relationship such that ends of adjoining openings are located at aligned positions or partially overlapping positions in a longitudinal direction of the cross-sectional shape.

6. A blower device comprising:

a blower that sends air; and the blower duct according to claim 1 that takes in the air sent from the blower.

7. An image forming apparatus comprising:

an image forming unit that forms an image; and the blower device according to claim 6 that blows air onto a corona discharger that is long in one direction.

* * * * *